United States Patent [19]

Jureckson

[11] Patent Number: 4,896,779

[45] Date of Patent: Jan. 30, 1990

[54] DISPLAY SHELF ORGANIZER

[75] Inventor: Mitchell Jureckson, Edgewater, N.J.

[73] Assignee: L'Oreal, S.A., Paris, France

[21] Appl. No.: 86,108

[22] Filed: Aug. 14, 1987

[51] Int. Cl.[4] ..... A47F 5/00

[52] U.S. Cl. ..... 211/184; 211/94

[58] Field of Search ..... 211/184, 162, 94, 54.1, 211/59.1, 57.1; 248/225.1; 312/234.4; 108/60, 61

[56] References Cited

U.S. PATENT DOCUMENTS

| | | | |
|---|---|---|---|
| Des. 276,661 | 12/1984 | Cafazzo . | |
| 2,608,777 | 9/1952 | Schuler . | |
| 2,730,825 | 1/1956 | Wilds . | |
| 3,167,187 | 1/1965 | Sarkisian . | |
| 3,295,690 | 1/1967 | Ottman . | |
| 3,702,508 | 11/1972 | Netter . | |
| 3,868,021 | 2/1975 | Heinrich . | |
| 4,125,243 | 11/1978 | Liptak | 248/205.3 X |
| 4,615,276 | 10/1986 | Garabedian | 211/184 X |
| 4,658,967 | 4/1987 | Wang | 211/94 |
| 4,693,441 | 9/1987 | Conway | 248/225.1 |
| 4,735,324 | 4/1988 | Wilcek | 211/184 |

FOREIGN PATENT DOCUMENTS

| | | | |
|---|---|---|---|
| 1167308 | 4/1964 | Fed. Rep. of Germany | 312/234.4 |
| 694795 | 9/1965 | Italy | 312/234.4 |

*Primary Examiner*—Alvin C. Chin-Shue
*Assistant Examiner*—Sarah A. Lechok
*Attorney, Agent, or Firm*—Brumbaugh, Graves, Donohue & Raymond

[57] ABSTRACT

A display shelf organizer comprises a front channel to which are releasably secured a plurality of spaced apart dividers defining a plurality of compartments for displaying a plurality of products. A slider at the front end of each divider is slidable in a longitudinal track hingedly mounted on the front channel at the rear thereof enabling the dividers to be assembled to the front channel in spaced apart relation to form the display compartments. A plurality of holders for samples or promotional material are slidably mounted in a track at the front of the front channel and positioned in relation to products displayed in the compartments. The shelf organizer may be mounted on a shelf and secured thereto adhesively.

5 Claims, 2 Drawing Sheets

DISPLAY SHELF ORGANIZER

BACKGROUND OF THE INVENTION

This invention relates to a display shelf organizer for hair color products and the like. More particularly, it relates to a new and improved shelf organizer of this character that enables a plurality of such products to be displayed effectively in relation to samples illustrating the results likely to be obtained by the use of the products.

Display shelf organizers have been proposed heretofore that comprise a container adapted to be placed on a shelf and having a plurality of side-by-side storage areas for products to be displayed, with a member at the front of the container for displaying price or other descriptive information regarding the use of the products. Such devices have usually been made of metal in standard sizes with no provision for easy modification to display effectively more or less than a standard number of products. Moreover, when such devices have been designed to display with the products samples or other information to assist a customer in determining which product to buy, it has not been possible to change or replace the samples or information easily.

It is an object of the invention, accordingly, to provide a new and improved display shelf organizer of the above character that is free from the aforementioned deficiencies of the prior art.

Another object of the invention is to provide a new and improved display shelf organizer of the above character that can be readily adjusted in size to accommodate effectively a range of products for display.

Another object of the invention is to provide a new and improved display shelf organizer of the above character in which samples or other information displayed in relation to the products exhibited can easily be replaced.

A further object of the invention is to provide a new and improved display shelf organizer of the above character that is effective in use and pleasing in appearance.

SUMMARY OF THE INVENTION

According to the invention, a display shelf organizer comprises a front channel to which are releasably secured a plurality of spaced apart dividers defining a plurality of side-by-side compartments or channels in which a plurality of different products are adapted to be displayed. Each divider is provided with a slider at the front end thereof that is adapted to the received in a longitudinal track hingedly mounted on the front channel at the rear thereof, enabling the dividers to be assembled to the front channel in predetermined spaced relationship to form channels for the different products as desired.

The front channel is also provided with upper and lower inturned flanges on the front thereof, forming a second track in which a plurality of holders for samples or promotional or explanatory matter related to the products to be displayed are adapted to be slidably received and positioned removably in front of the respective products.

The shelf organizer is preferably made of a pliable plastic material which is susceptible of easy modification to accommodate the number of products to be displayed. Also, end caps are provided for the front channel to prevent inadvertent removal of the divider sliders and sample holders from their tracks and to present a finished appearance.

In use, the front channel is sized to accommodate the number of dividers required, and the latter are secured to the front channel by inserting the sliders thereon into the track at the rear of the channel and supporting the assembly on an existing shelf. The dividers are spaced apart as required to produce the required number of product display compartments or channels and are secured to the shelf in any suitable manner, as by adhesive, for example. The holders for samples or promotional or explanatory matter are inserted into the second track in front of the front channel to positions adjacent the channels in which the respective products are to be displayed, and the end caps are fitted over the opposite ends of the front channel.

DESCRIPTION OF A PREFERRED EMBODIMENT

The invention may be better understood from the following description taken in conjunction with the accompanying drawings, in which.

Figure 1:
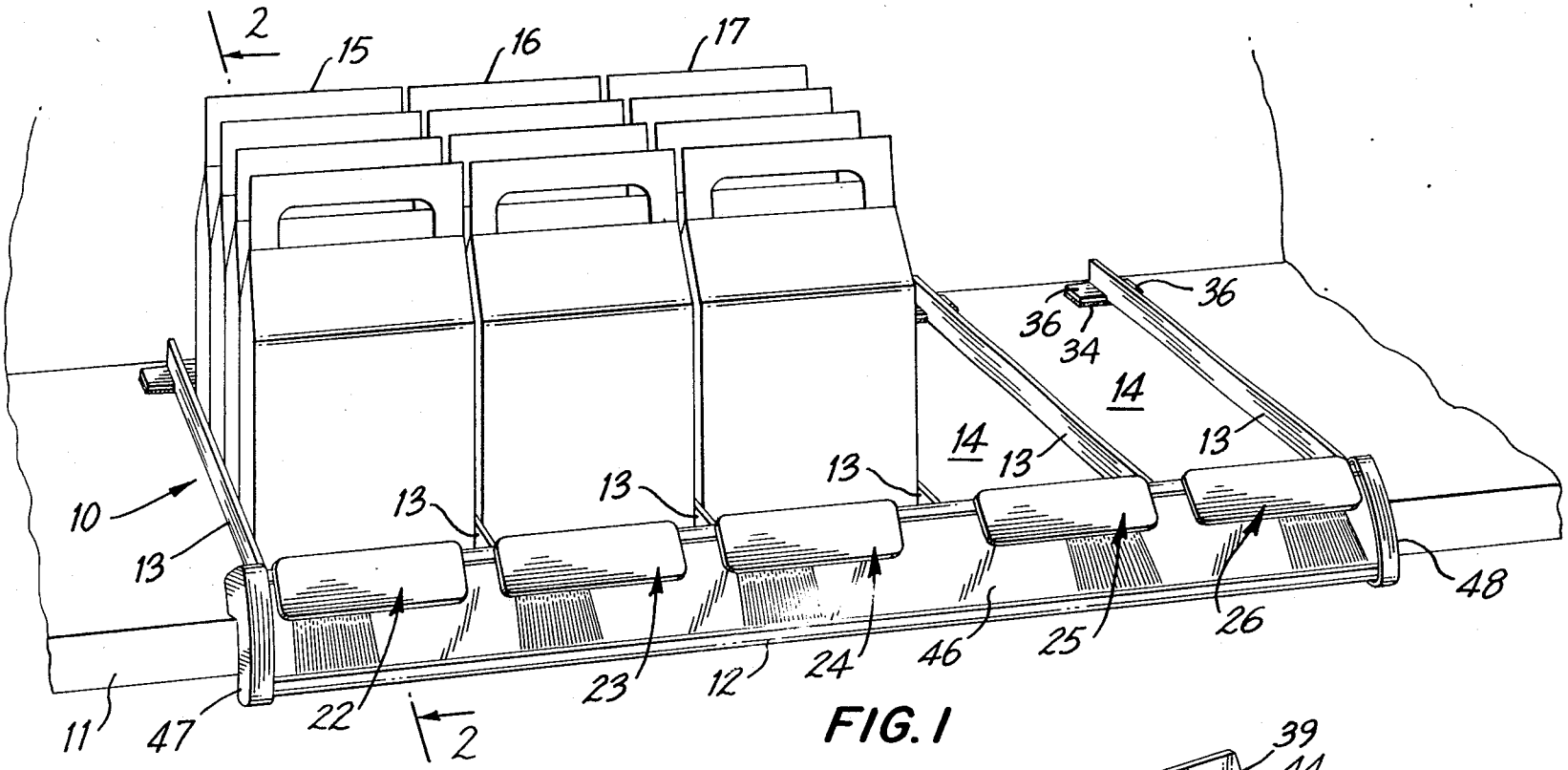
FIG. 1 is a front perspective view of a display shelf organizer according to the invention, supported on an existing shelf.

For purposes of illustration, the shelf organizer of the invention will be described below as adapted for the display of packages of hair colorings. In FIG. 1, the shelf organizer 10 is mounted on a shelf 11 in a retail establishment, for example, and it comprises a front channel 12 provided with a plurality of rearwardly extending dividers 13 defining a plurality of compartments or channels 14 in which rows of different products 15, 16, 17 are to be displayed. The front channel 12 is generally outwardly convex in cross-section and it is formed with inturned, longitudinally extending flanges 18 and 19 (FIG. 5) at the top and bottom thereof defining inwardly open grooves 20 and 21 in which a plurality of sample holders 22, 23, 24, 25 and 26 (FIG. 1) are adapted to be slidably received and positioned in front of the respective products to be displayed.

Figure 6:
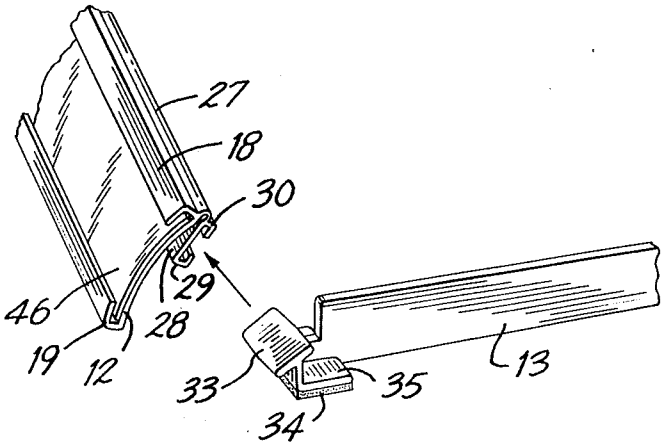
FIG. 6 is a perspective view illustrating how a slider on a divider in the device of FIG. 1 is inserted into a track at the rear of the front channel.
Figure 5:
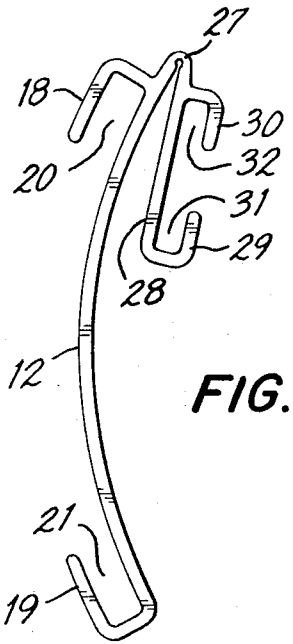
FIG. 5 is an enlarged end view of the front channel of the device shown in FIG. 1.

As best shown in FIGS. 5 and 6, the flexible material of which the front channel 12 is made is reduced in thickness to form a longitudinally extending hinge 27 securing a longitudinally extending track 28 to the front channel 12. The track 28 may be formed by inwardly directed longitudinally extending flanges 29 and 30 defining inwardly open grooves 31 and 32 in which angled sliders 33 formed at the front end of each divider 13 are adapted to be slidably received and positioned so as to define compartments or channels 14 for the products to be displayed.

Figure 3:
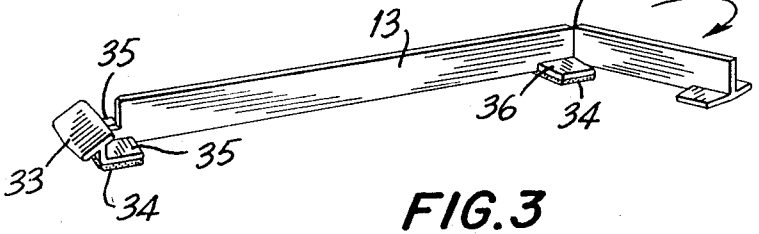
FIG. 3 is a side perspective view of a typical product channel divider for the shelf organizer shown in FIG. 1.
Figure 2:
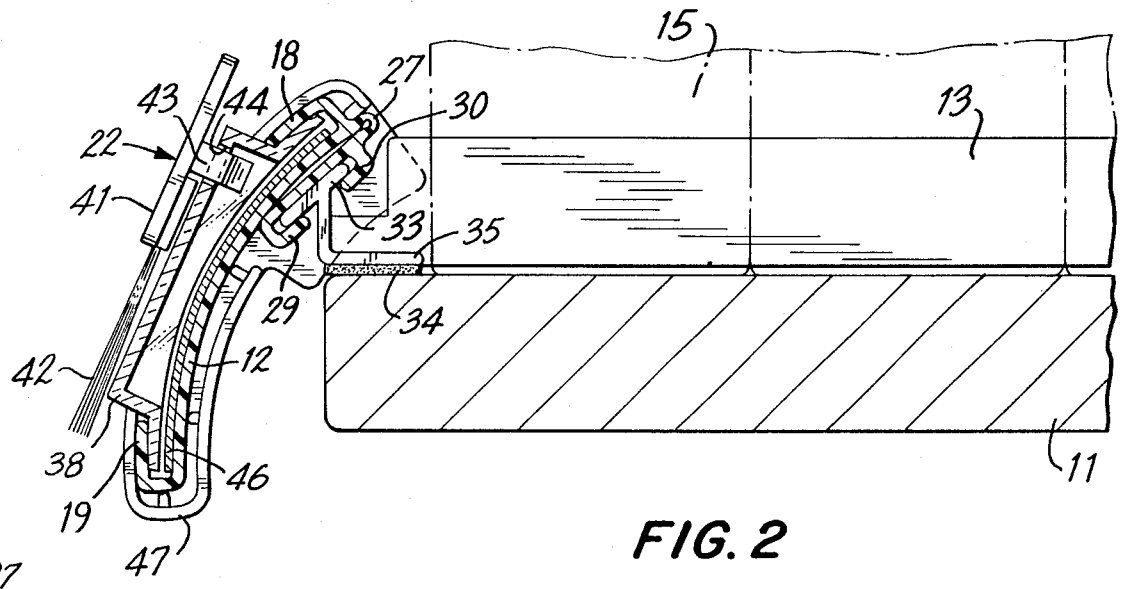
FIG. 2 is a view in transverse section along the line 2—2 of FIG. 1, looking in the direction of the arrows.
Figure 7:
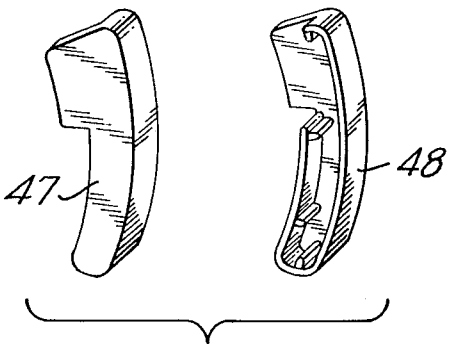
FIG. 7 illustrates in perspective opposite end caps for the front channel in the device of FIG. 1, one as viewed from the outside and the other as seen looking towards the inside.

To assemble the shelf organizer, the front channel 12 is cut to the length required to accommodate the desired number of product display compartments. It is then positioned as shown in FIG. 6 with the track 28 folded downwardly,and the sliders 33 of as many dividers 13 as are required to form the number of display compartments desired are inserted into the track 28. The front channel 12 and the dividers 13 are then positioned on the shelf 11 (FIG. 2) and secured thereto in any suitable manner, as by adhesive pads 34 interposed between the surface of the shelf and tabs 35 and 36 formed at the front and rear ends of each divider 13, as shown in FIGS. 1 and 6. The dividers 13 may be scored at 37 (FIG. 3) to enable part thereof to be broken off so that they will fit narrow shelves.

Figure 4:
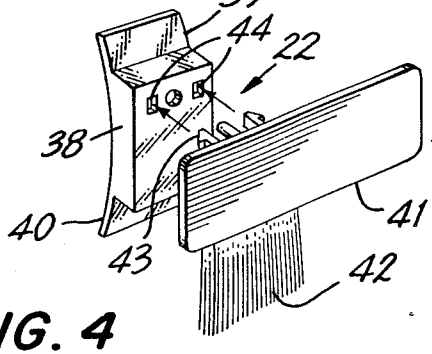
FIG. 4 is an exploded view of a holder for samples or promotional or explanatory material to be viewed in relation to products displayed in the shelf organizer shown in FIG. 1.

The sample holders or carriers are all essentially the same and it will be necessary to describe only one in detail. Referring now to FIG. 4, the sample holder or carrier 22 comprises a slider 38 shaped arcuately to conform generally to the shape of the channel member 12 and having upper and lower flanges 39 and 40 sized and shaped for easy entry into the grooves 20 and 21 in the channel member 12 and for sliding movement therein. Releasably secured to each slider 38 is a mounting 41 to which is secured a sample such as a hair swatch 42, for example. The mounting 41 may be provided with conventional detent means 43 insertable in openings 44 in the slider 38 to secure the mounting 41 releasably thereto.

In a typical presentation, it may be desired to display, for example, a product intended to impart soft color highlights to hair and available in different formulations for hair of different colors. For such use, the shelf organizer may be assembled to the shelf 11 as described above with as many dividers 13 as required to provide compartments or channels 14 for the several products to be displayed. Thus, a plurality of different formulations of the product, e.g. for light blond hair, for light brown hair and for dark brown hair, may be displayed in separate channels 13. Positioned in registry with each product row is a sample holder carrying, for example, a swatch of hair of the color for which the product was formulated, after it has been treated with the product, to demonstrate to a prospective customer the effect produced by the product.

Each sample holder may also carry suitable advertising copy or explanatory matter on the front thereof. Also, an insert strip 46 which may be of the same width and length as the front channel may be inserted into the grooves 20 and 21 and positioned beneath the sample holders to carry additional promotional or explanatory matter.

End caps 47 and 48 shaped to conform to the cross-section of the front channel 12 are then fitted over the ends of the latter to impart a neat, finished appearance to the assembled device and to prevent the sample holders from being inadvertently removed.

The shelf organizer of the invention may be supplied in the form of a kit with parts to form, say, five display channels. If it is desired to display less than five products, the plastic front channel can be cut to the proper width and fitted with the necessary reduced number of separators, and the end caps put in place to provide a neat and effective display. Alternatively, if more than five products are to be displayed, two shelf organizers can be used in side-by-side relation on a shelf, an insert strip 46 of suitable length being used to bridge the gap between the two, so that the assembly has an attractive, finished appearance.

The invention thus provides a novel and highly effective shelf organizer that can easily be tailored to accommodate as many products as desired while retaining a neat and finished appearance. Moreover, by virtue of the close association of the sample holders with the respective displayed articles, it is possible for a customer to readily determine which of a plurality of products being displayed is best suited to her needs. In addition, the construction of the sample holders makes it possible for the samples to be easily changed or replaced.

The specific embodiments described are intended to be merely illustrative, and modifications in form and detail are possible within the scope of the following claims.

I claim:

1. A display shelf organizer comprising, in combination, at least two flat, elongated shelf divider elements having like length and width dimensions, each individually securable at one end thereof to the forward edge portion of the upper surface of a shelf with its width dimension disposed perpendicular to said upper surface to extend perpendicularly from the forward edge of the shelf toward the rearward edge thereof in spaced parallel relationship with at least one other divider element and with the upper surface of the shelf defining a compartment for articles to be displayed;

a slider element attached to said one end of each shelf divider element, each said slider element including a thin, flat, rectangularly-shaped member which when the shelf divider is secured to a shelf as aforesaid is disposed above the surface of the shelf and is inclined downwardly and forwardly with respect to the forward edge of the shelf with its length dimension disposed parallel to the forward edge of the shelf;

an elongated channel member formed from an elongated rectangular sheet of flexible material comprising rectangularly-shaped front and rear members each having front and back surfaces, said front and rear members being defined by a longitudinally extending line of reduced thickness which forms a longitudinally extending hinge along which said front member is folded forwardly so that its back surface overlies the front surface of said rear member, said rear member having a first longitudinally extending track formed on its back surface by a pair of integral, in-turned, parallel flanges spaced apart by a distance substantially equal to the width dimension of said slider elements so as to receive said slider elements for detachably securing said channel member forwardly of the forward edge of the shelf, said front member having a pair of in-turned, parallel longitudinally extending flanges integrally formed on its front surface defining a second, forwardly-facing track; and at least one carrier member having a slider element dimensioned to be received in and to be moveable along said second track so as to be positionable as desired with respect to a compartment.

2. A display shelf organizer as defined in claim 1, wherein each carrier member comprises a slider element and a display member releasably mounted to the slider element with cooperating detent means.

3. A display shelf organizer as defined in claim 1, wherein each divider element includes means affixed to its underside edge for adhesively securing the divider element to a shelf.

4. A display shelf organizer as in claim 3 in which said means for adhesively securing the divider element to a shelf comprises tabs formed at the ends of the divider element on the underside thereof, and an adhesive pad secured to the underside of each tab so as to be interposed between the surface of the shelf and a respective tab.

5. A display shelf organizer as defined in claim 1, wherein said elongated channel member is formed of a pliable plastic material and wherein the front member of said channel member is wider than said back member and generally outwardly convex in cross-section.

* * * * *